US006708935B2

(12) United States Patent
Smeed

(10) Patent No.: US 6,708,935 B2
(45) Date of Patent: Mar. 23, 2004

(54) DEVICE FOR UPPER EXTREMITY ELEVATION

(75) Inventor: Eric M. Smeed, Bradenton, FL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/209,276

(22) Filed: Aug. 1, 2002

(65) Prior Publication Data

US 2002/0179782 A1 Dec. 5, 2002

Related U.S. Application Data

(63) Continuation-in-part of application No. PCT/US01/05559, filed on Feb. 22, 2001.

(60) Provisional application No. 60/183,778, filed on Feb. 22, 2000.

(51) Int. Cl.[7] ..... B68G 5/00

(52) U.S. Cl. ..... 248/118; 5/646; 5/623; 128/878

(58) Field of Search ..... 248/118, 118.1, 248/118.3, 288.11, 289.11; 5/623, 624, 621, 646; 128/878, 845, 846; 602/5, 20

(56) References Cited

U.S. PATENT DOCUMENTS

| | | | | |
|---|---|---|---|---|
| 473,200 | A | 4/1892 | Streeter | |
| 541,863 | A | 7/1895 | Loomis | |
| 988,923 | A | 4/1911 | Bauerfeind | |
| 1,516,795 | A | * 11/1924 | Schwarting | 5/623 |
| 2,119,325 | A | * 5/1938 | Goodhart | 602/16 |
| 2,459,033 | A | * 1/1949 | Kraus | 5/623 |
| 2,614,558 | A | 10/1952 | Lovell | |
| 2,630,288 | A | 3/1953 | Eubanks, Sr. | |
| 3,614,085 | A | 10/1971 | Cunningham | |
| 4,545,573 | A | * 10/1985 | Murphy | 5/624 |
| 4,679,756 | A | 7/1987 | Wood | |
| 4,708,510 | A | * 11/1987 | McConnell et al. | 403/90 |
| 4,815,688 | A | 3/1989 | Wood | |
| 4,913,413 | A | * 4/1990 | Raab | 5/624 |
| 5,174,533 | A | * 12/1992 | Pryor et al. | 248/288.51 |

(List continued on next page.)

OTHER PUBLICATIONS

MLA Patient Transfer Systems, main page, printed from http://www.mlapts.com/main.html on Jul. 19, 1999.

Wy'East Medical, "Specialized Equipment for Patient Transfer Without Lifting," printed from http://www.wyeast-med.com/index.html on Jul. 19, 1999.

Wy'East Medical, "Totalift–II Transfer/Transport Chair," printed from http://www.wyeastmed.com/page2.html. on Jul. 19, 1999.

Wy'East Medical, "Totalift–250 Transfer/Transport Stretcher," printed from http://www.wyeastmed.com/page3.html. on Jul. 19, 1999.

Wy'East Medical, "TC–300 Treatment Chair," printed from http://www.wyeastmed.com/page4.html. on Jul. 19, 1999.

3 pictures of components for use as part of a prior art upper extremity elevation device.

U.S. Government, Order for Supplies or Services, Apr. 11, 1994.

*Primary Examiner*—Korie Chan
*Assistant Examiner*—A. Joseph Wujciak
(74) *Attorney, Agent, or Firm*—Elizabeth Arwine

(57) ABSTRACT

The device is used for supporting an upper extremity limb of a patient located in either a bed or a chair. The device preferably includes bracket, a pole, a knee joint, a cradle, and an extremity support. Preferably, the knee joint provides movement in three radial directions to allow for optimal placement of the extremity support for a particular patient. The bracket preferably provides the flexibility to attach to a wide variety of furniture.

17 Claims, 7 Drawing Sheets

U.S. PATENT DOCUMENTS 5,281,001 A 1/1994 Bergsten et al.
5,287,575 A * 2/1994 Allen et al. ..... 5/623
5,368,536 A * 11/1994 Stodgell ..... 482/79
5,375,276 A 12/1994 Nelson et al.
5,385,536 A * 1/1995 Burkhead et al. ..... 602/20
5,661,859 A * 9/1997 Schaefer ..... 5/621
5,681,018 A * 10/1997 Hoftman ..... 248/125.8
5,713,591 A * 2/1998 Zarkhin et al. ..... 280/250.1
5,839,136 A 11/1998 Vance et al.
5,864,902 A 2/1999 Rogers
6,138,970 A * 10/2000 Sohrt et al. ..... 248/278.1
6,170,598 B1 * 1/2001 Furukawa ..... 180/334
6,220,556 B1 * 4/2001 Sohrt et al. ..... 248/279.1
6,622,324 B2 * 9/2003 VanSteenburg et al. ..... 5/621
6,629,944 B2 * 10/2003 Smart ..... 602/36

* cited by examiner

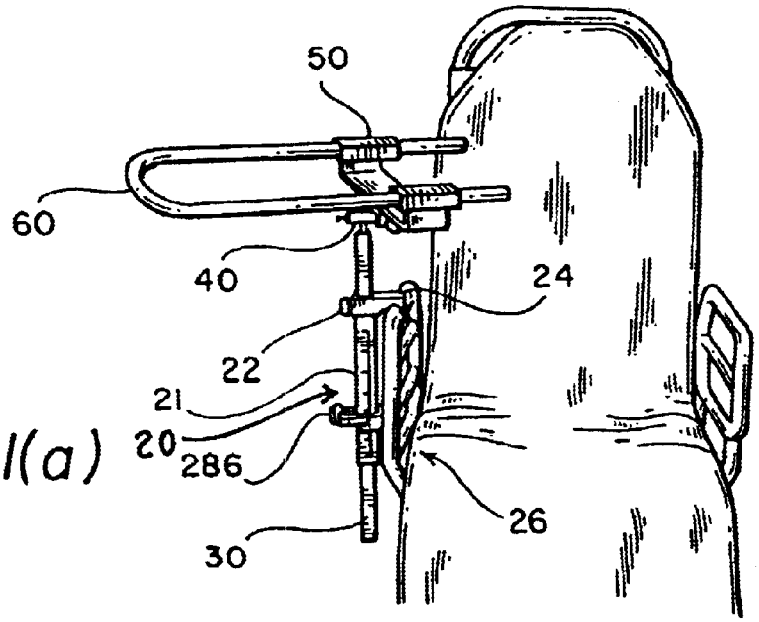
FIG. 1(a)
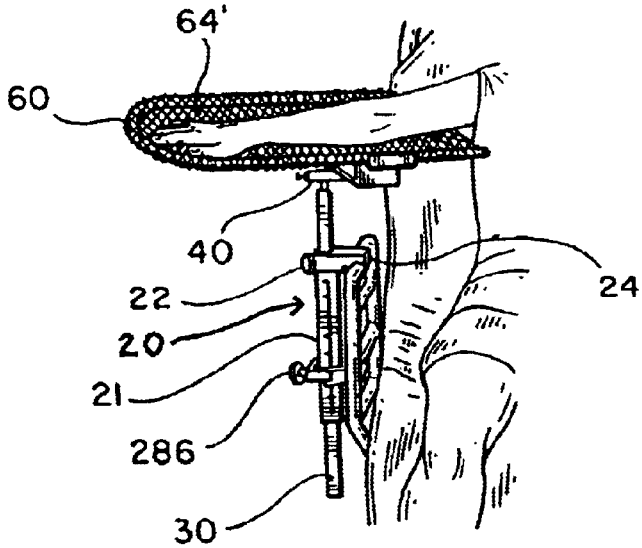
FIG. 1(b)
FIG. 10(d)
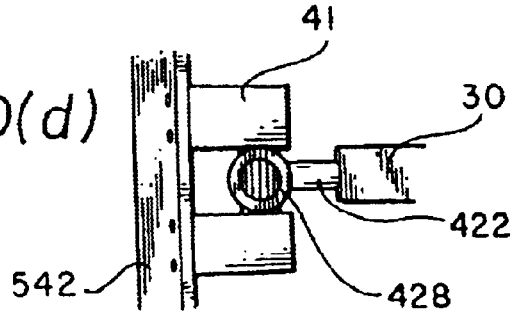

FIG. 2
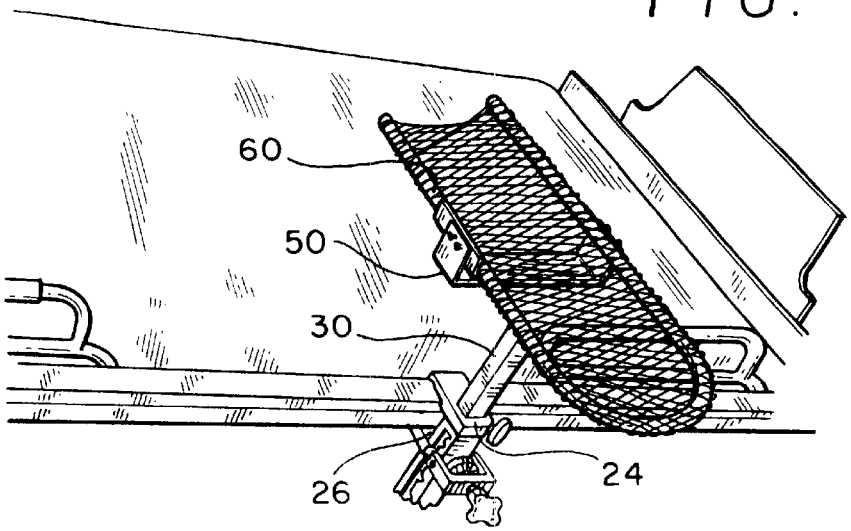
FIG. 10(a)
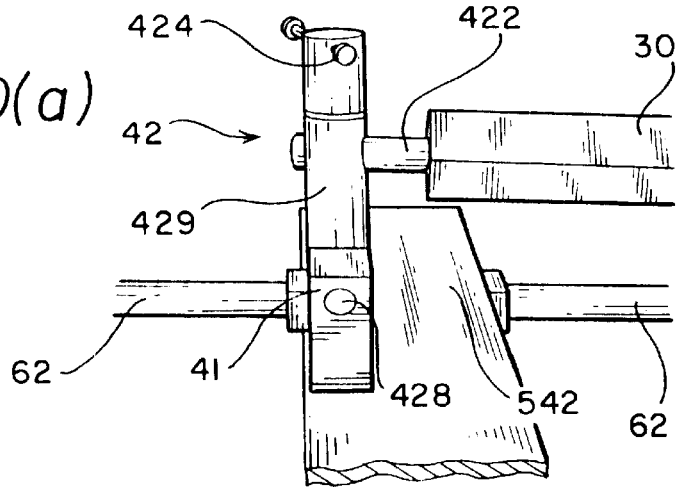
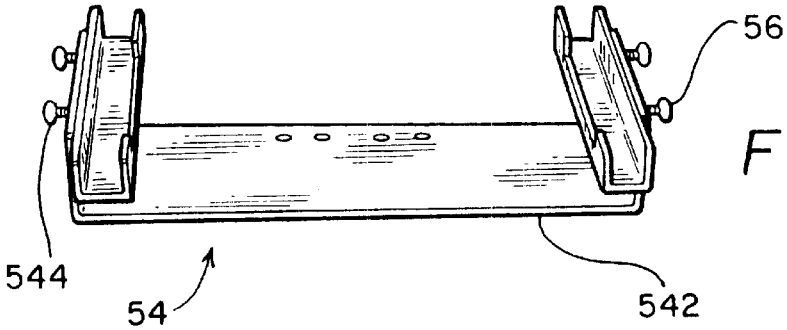
FIG. 9(b)

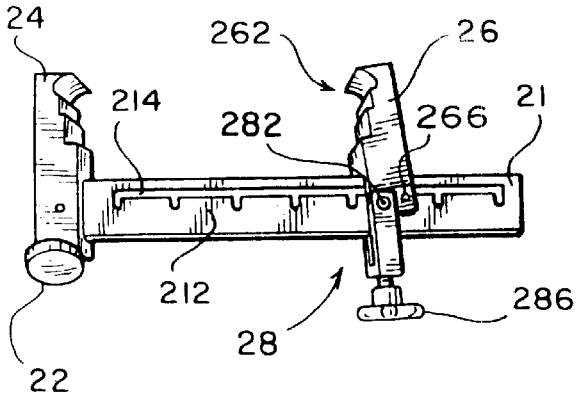
FIG. 8(a)
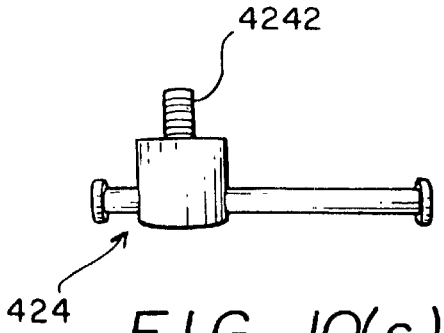
FIG. 10(c)
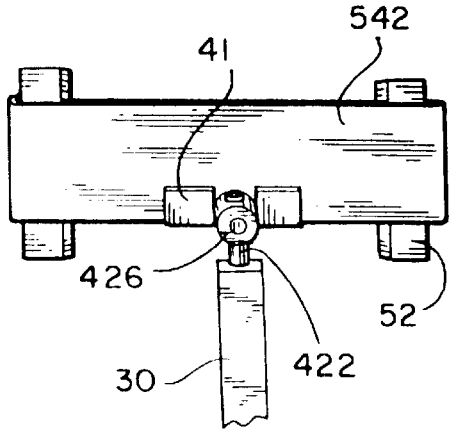
FIG. 10(b)
FIG. 9(a)
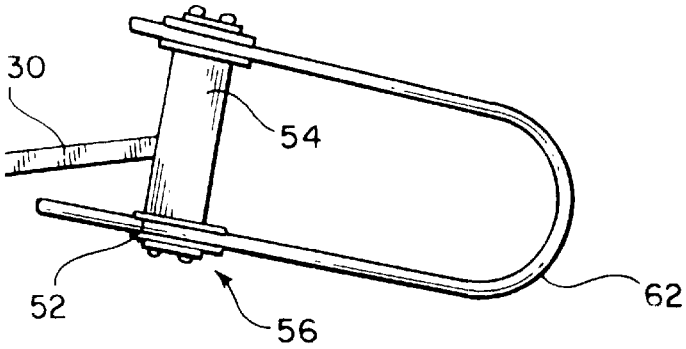
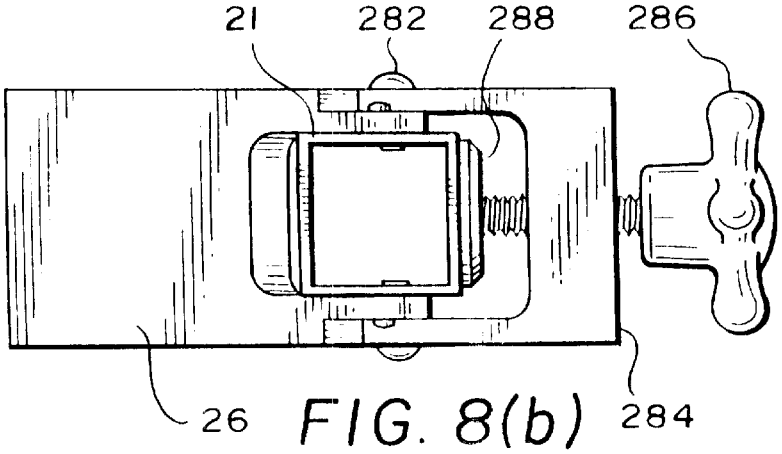
FIG. 8(b)

DEVICE FOR UPPER EXTREMITY ELEVATION

This application is a continuation-in-part application of PCT Application number PCT/US01/05559, filed Feb. 22, 2001 (which designates the United States and was published on Aug. 30, 2001), which claims the benefit of U.S. provisional Application Ser. No. 60/183,778, filed Feb. 22, 2000. Each of these applications is hereby incorporated by reference.

I. FIELD OF THE INVENTION

This invention preferably relates to a support system for attachment to different beds and chairs. More particularly, the device preferably is a support structure attached to a cradle connected to a knee joint attached to a pole attached to a bracket, which then attaches to either a bed or a chair in which a patient is located who requires his/her extremities to be supported.

II. BACKGROUND OF THE INVENTION

The prior art device and jerry rigged devices used by the inventors provided less flexibility in terms of what the devices could attach to in terms of different beds and chairs. The prior art device offered only a limited range of adjustments. The prior art devices easily rusted because of their steel construction or broke during use because of poor design.

When the prior art device was unable to attach to a particular chair or bed frame, a jerry-rig setup was used. The usual design was to use IV poles with a sling hanging from it. The purpose of a sling is to keep a particular body part in a fixed position relative to the rest of the body, which becomes more critical when the patient is a burn patient. The sling used with the IV pole is similar to the type of sling that is utilized to hold a person's arm against their chest, but instead of the loop going around the neck, the loop hangs from the IV pole. This type of sling will apply pressure over a greater area of the slinged body part such that if the patient has a burn this may lead to further complications resulting from both the applied pressure and the increase likelihood of chafing between the body part and the sling.

An inherent problem with this design is the difficulty of fixing the IV poles relative to the bed/chair. The IV poles usually have wheels on their bottom and are easily tipped over if there is a quick movement by a patient who has an arm in a sling hanging from the IV pole. As is imaginable, it is difficult for one individual to move a patient in a chair while controlling the one or two accompanying IV poles. Thus, it becomes necessary for two people to move the patient to provide adequate control and relative positioning of the sling(s) to the chair and patient.

Notwithstanding the usefulness of the above-described devices, a need still exists for a more convenient device that provides added flexibility, sturdy support, and increase ease of use.

I. SUMMARY OF THE INVENTION

This invention solves the ongoing problems of using the prior art devices and arrangements by adding additional flexibility in attachment and positioning of the extremity support. The invention while addressing the problems of the prior art obtains advantages that were not previously achievable.

This invention preferably includes an extremity support, a cradle, a knee joint, a pole, and a bracket. The cradle and the knee joint together provide greater positionability than that achievable by the prior art. The bracket is capable of attaching to a greater variety of structures through its adjustment mechanism.

An object of this invention is to provide greater flexibility in what structures the support system is attached to during use.

Another object of this invention is to increase the range in which the extremity may be positioned relative to the body.

Another object of this invention is to simplify the method of attaching the bracket to different structures.

Another object of this invention is to increase the strength and the tightness of the connection between the bracket and the attached structure.

A further object of this invention is to simplify the movement of a patient between two locations.

An advantage of this invention is that it is simpler to use than the prior art devices in setting up the device for use with a patient.

Another advantage of this invention is the improvement in the quality of care resulting from the elimination of the need to jerry-rig a device.

Another advantage of this invention is the improvement obtained in having a more rigid support mechanism attached to the extremity support.

Another advantage of this invention is that the extremity support may be positioned in new positions relative to the patient that were not possible with the prior art devices.

Another advantage of the invention is that it is more ergonomical than the prior art devices.

Another advantage of the invention is the flexibility that will be allowed in future purchases of beds and chairs, because of the attachment range of the bracket.

A further advantage of the invention is the durability of the preferred construction of the invention.

A further advantage of the invention in the preferred embodiment is the ease in cleaning the device as necessitated by use of the device.

Further features and advantages of the present invention, as well as the structure and operation of various embodiments of the present invention, are described in detail below with reference to the accompanying drawings. Given the following enabling description of the drawings, the apparatus should become evident to a person of ordinary skill in the art.

II. BRIEF DESCRIPTION OF THE DRAWINGS

The present invention is described with reference to the accompanying drawings. In the drawings, like reference numbers indicate identical or functionally similar elements.

FIG. 1(*a*) illustrates a view of an embodiment according to the invention attached to a chair. FIG. 1(*b*) illustrates the combination depicted in FIG. 1(*a*) being used by an individual.

FIG. 2 depicts an embodiment according to the invention attached to a bed.

FIG. 3(*b*) illustrates a cross-section taken at 3(*b*)—3(*b*) of FIG. 3(*a*).

Figure 4B:
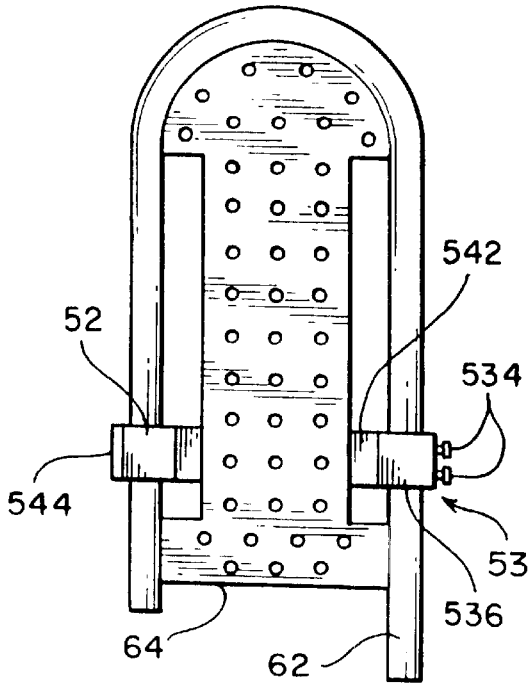
Figure 4A:
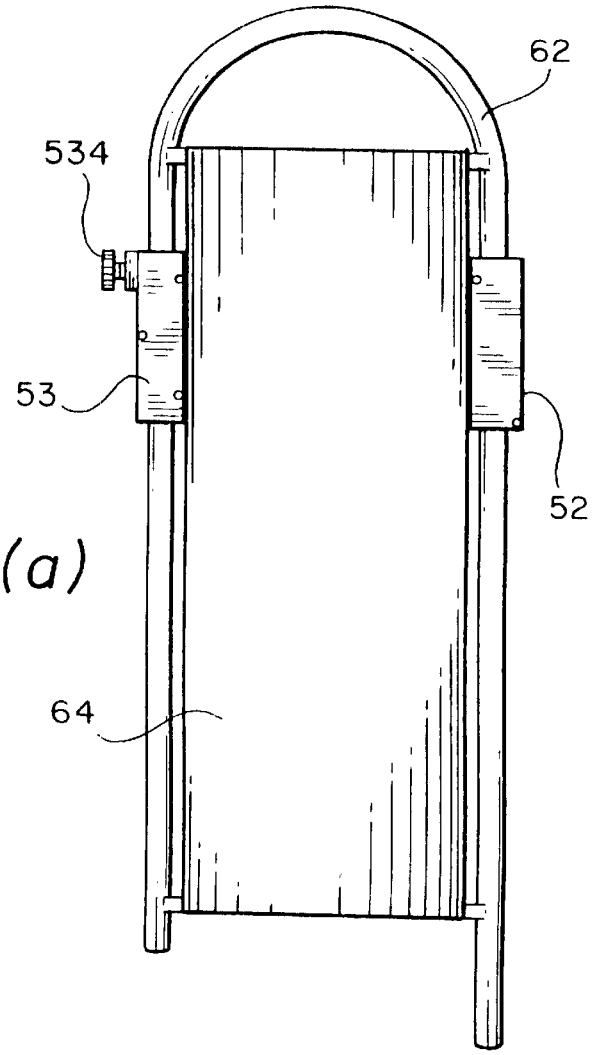

FIGS. 4(*a*) and (*b*) each depict a top view of an embodiment of a combination of an extremity support and a cradle according to the invention.

Figure 5B:
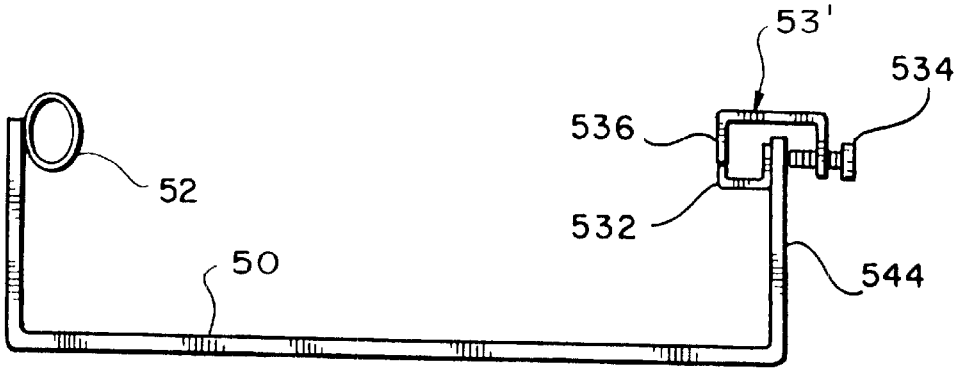
Figure 5A:
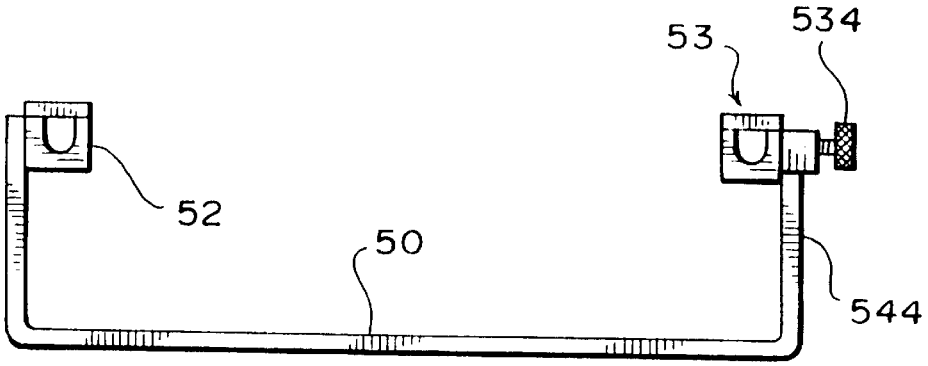

FIGS. 5(*a*) and (*b*) each illustrate a side view of an embodiment of the cradle according to the invention.

Figure 6A:
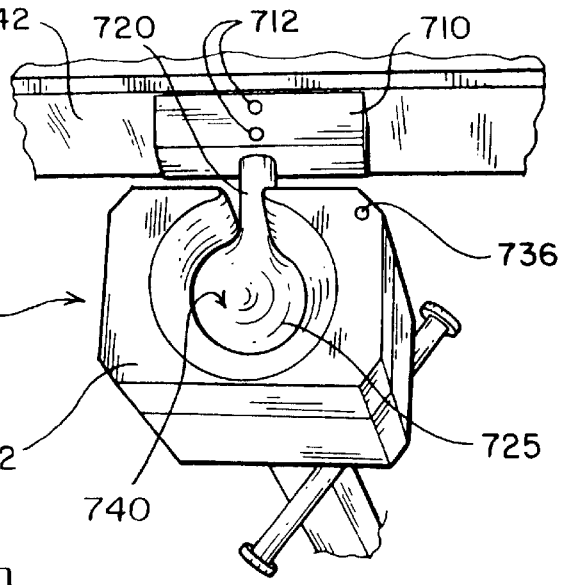
Figure 6B:
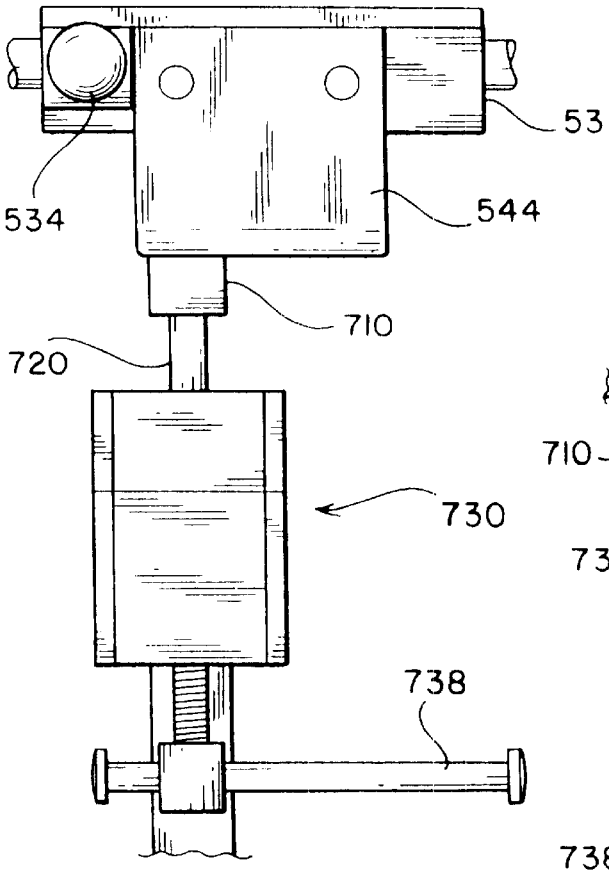
Figure 6C:
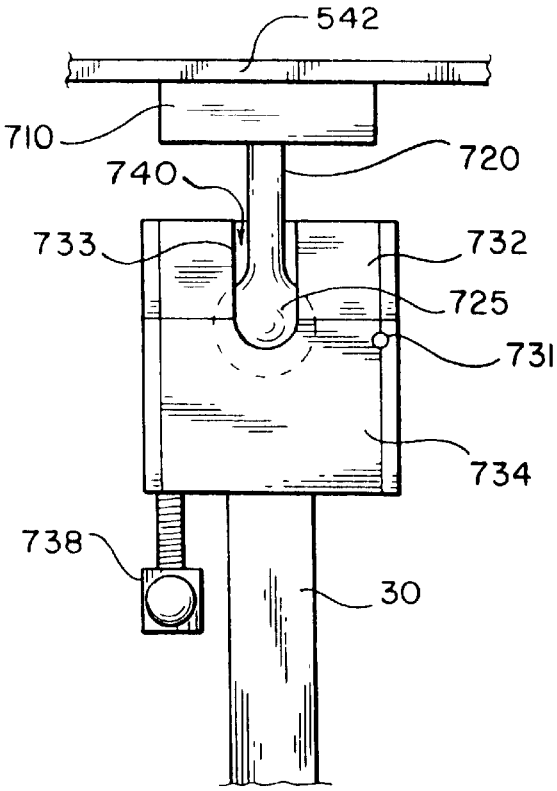

FIG. 6(*a*) depicts a top view of a preferred embodiment of the knee joint. FIGS. 6(*b*) and (*c*) illuatrate side views of the preferred embodiment of the knee joint.

Figure 7A:
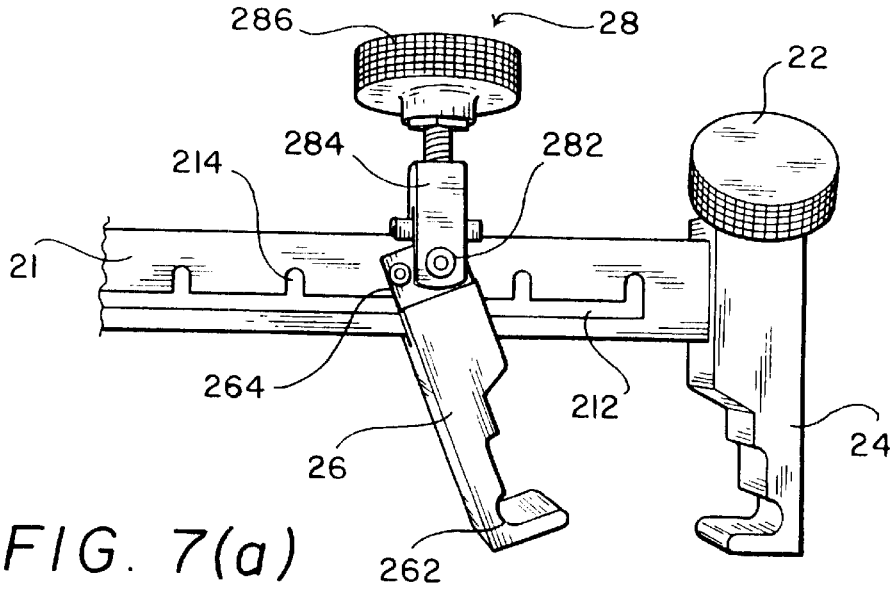
Figure 7B:
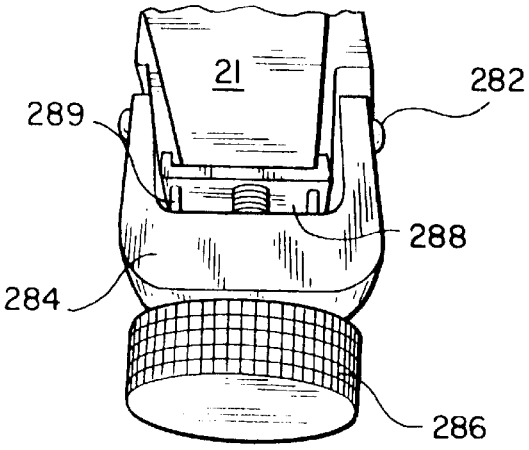
Figure 7C:
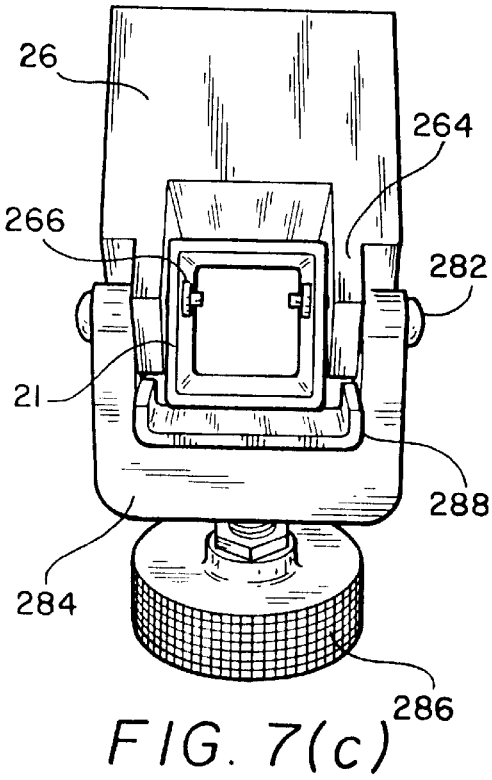

FIG. 7(*a*) depicts a side view of a top portion of a preferred embodiment of the bracket according to the invention. FIGS. 7(*b*)–(*c*) depict a perspective view of an embodiment of a clamp adjustor according to the invention.

FIG. 8(*a*) illustrates a side view of an alternative embodiment of a bracket according to the invention. FIG. 8(*b*) illustrates a bottom view of the embodiment of FIG. 8(*a*).

FIG. 9(*a*) depicts a top view of an alternative embodiment of a bar connected to a cradle according to the invention. FIG. 9(*b*) illustrates a perspective view of the bracket depicted in the embodiment of FIG. 9(*a*).

Figure 10E:
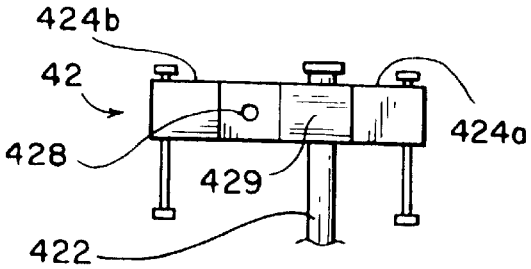

FIGS. 10(*a*)–(*e*) illustrate views of an alternative embodiment of the knee joint. FIG. 10(*a*) illustrates a side view of an embodiment of a polar rotational mechanism according to the invention. FIG. 10(*b*) depicts an end view of the embodiment of FIG. 10(*a*) with the locking mechanism removed. FIG. 10(*c*) illustrates a side view of the removed locking mechanism. FIG. 10(*d*) illustrates another end view of the embodiment of FIG. 10(*a*) with the locking mechanisms not present. FIG. 10(*e*) illustrates a side view of the embodiment of FIG. 10(*a*) with a second locking mechanism.

II. DETAILED DESCRIPTION OF THE INVENTION

FIGS. 1(*a*)–2 illustrates an embodiment of the invention installed on typical hospital patient care equipment. FIGS. 2–7(*c*) illustrate a preferred embodiment of the invention. In accordance with the present invention, the apparatus preferably includes a bracket 20 (or clamp means), a pole 30, a knee joint 40, a cradle 50, and an extremity support 60.

Figure 3A:
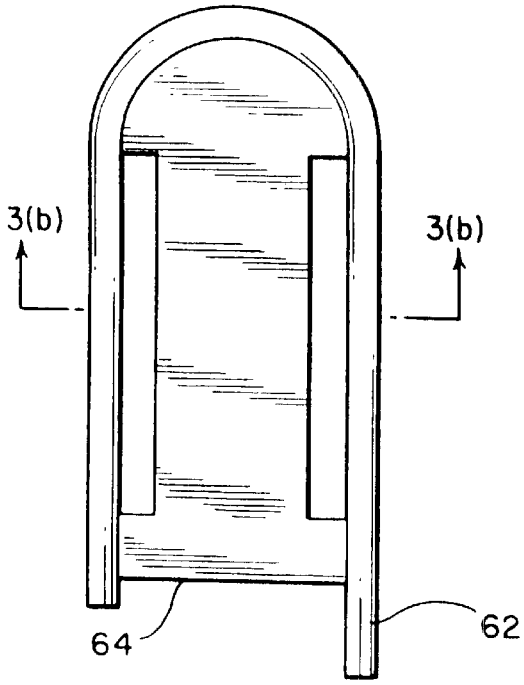
FIG. 3(*a*) illustrates a top view of a preferred embodiment of an extremity support according to the invention.
Figure 3B:
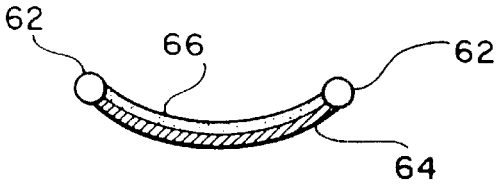

The support 60 preferably includes a U-shape bar 62 with a member 64 running along its length and between the two legs of the bar 62 as illustrated in FIG. 3(*a*). The member 64 preferably has a concave surface along its length such that a channel is formed along its length as illustrated in FIG. 3(*b*). The member 64 preferably is covered with padding 66 so that an individual's arm rests on the padding as illustrated in FIG. 3(*b*). An alternative embodiment is to have the member be meshed or to include an array of punched holes. Additionally, the member 64 preferably will include a folded over edge to prevent the edges of the member 64 from contacting the individual; however, the member 64 may instead have rounded edges.

The bar 62 preferably has even length legs as illustrated in FIGS. 1(*a*) and 1(*b*). Alternatively, the bar 62 may have one leg shorter than the other as illustrated, for example, in FIG. 3(*a*) to better conform to the patient's body, which becomes more important when the patient is in a chair than when a patient is in a bed. The bar 62 preferably has either a round or a square (or other polygon) cross-section, and the bar 62 preferably is either rounded or squared corners at its closed end when viewed from the top. The support 60 preferably attaches to the cradle 50 as illustrated, for example, in FIG. 4(*a*).

The cradle 50 in one aspect of the invention preferably can be positioned at an angle to the pole 30 via the knee joint 40. The cradle 50 preferably includes bar retainers 52, 53 and a base 54.

The base 54 preferably includes a bottom member 542 with two walls 544, 544 extending upwardly from the bottom member 542 as illustrated, for example, in FIG. 5. A variety of shapes for the cross-section of the cradle will work as long as the shape allows an extremity to reside in the space formed by the bottom member 542 and the walls 544, 544.

Both bar retainers 52, 53 preferably are wide enough to hold one leg of the bar 62 and reside respectively on a wall 544. The bar retainer 52 preferably is a cage (as illustrated in FIG. 5(*a*)) or a guide sleeve (as illustrated in FIG. 5(*b*)) that wraps around bar 62. The bar retainer 53 as illustrated, for example, in FIG. 5(*a*) preferably includes a cage attached (or mounted) on wall 544 with a passageway, tunnel, or the like passing through its length to allowed relative sliding between the cage and bar 62. The cage preferably also includes a second passageway, tunnel, or the like that intersects the first passageway and extends perpendicularly away from the bar 62. More preferably the second passageway extends to the outside of the cage away from the other wall 544 such that the at least one pressure mechanism 534 does not interfere with the placement of the patient's arm onto the cradle 50. Preferably, there is at least one pressure mechanism 534, and more preferably there is just one pressure mechanism 534 as illustrated in FIG. 5(*a*). The pressure mechanism preferably is a screw, and more preferably the screw is tipped with a plastic grommet or the like to reduce wear and tear on the bar 62.

An alternative bar retainer 53' is illustrated in FIG. 5(*b*) and preferably includes a ledge 532, at least one pressure mechanism 534, and a latch 536. The pressure mechanism 534 preferably passes through the latch 536, wall 544, and/or ledge 532 such that as the pressure mechanism 534 is tightened, so the latch 536 is pulled outward and applies pressure against the bar 62 and wall 544. The pressure mechanism 534 preferably is a screw or a pair of screws as illustrated in FIGS. 4(*a*) and (*b*), respectively.

The knee joint preferably includes a ball and socket structure as illustrated in FIGS. 6(*a*)–(*c*). The knee joint preferably includes an attachment block 710, a pole (or member) 720, a ball 725, and a socket block 730. The attachment block 710 preferably attaches to the bottom member 542 of the cradle 50 (the surface opposite of where the walls 544, 544 project away from it) in a variety of ways including, for example, rivets, screws, bolts, adhesives, welding, or other similar attachment means. The attachment block 710 may alternatively be integrally formed with the bottom member 542 as a unitary piece. The pole 720 preferably is connected to the attachment block 710 in a variety of ways including, for example, rivets, screws, bolts, adhesives, welding, or other similar attachment means. More preferably, the pole 720 is attached to the attachment block 710 with at least one securing pin 712, and most preferably with a pair of securing pins 712, 712. The at least one securing pin 712 preferably intersects the pole 720 through a radial of the pole 720. The attachment block 710 may alternatively be integrally formed with the pole 720 as a unitary piece.

The pole 720 and the ball 725 preferably are formed as a unitary piece. The ball 725 preferably is nested within the socket block 730 such that is can rotate about the axial center of the pole 720 and place the pole 720 at an angle from vertical including zero degrees. More preferably the pole angle may be in a range of 0 to 60 degrees, and most preferably in a range of 0 to 45 degrees. The use of degrees is in the absolute non-negative since and is not relative to any component of the invention. The degree ranges include their respective end points.

The socket block 730 preferably includes a pair of blocks 732, 734 hinged about hinge 731, which preferably is recessed within the blocks 732, 734, to allow easier assembly and manufacture of the invention. The top and bottom blocks 732, 734 preferably are stabilized relative to each other with a dial pin 736, which preferably prevents the top block 732 from shifting relative to the lower block 734. The blocks 732, 734 are tightened together preferably with a locking mechanism 738 that preferably includes a spindle that passes through the lower block to engage the top block. The locking mechanism 738 may alternatively be a knob or other handle with a screw blot extending from the knob. The top block 732 preferably includes an upper part of the cavity 740 for engaging the ball 725, and more preferably includes a majority of surface area of the cavity. The top block 732 alternatively may include a slot 733 that extends from the cavity to its outside wall to allow for a more compact storage of the invention. The bottom block 734 preferably includes the lower part of the cavity 740, and more preferably includes less than half of the surface area of the cavity. Most preferably the cut line between the two blocks 732, 734 is not centered about the horizontal center of the ball 725 to increase the securing force of the socket block 730. The socket block 730 may be attached to the pole 30 in a variety of ways including, for example, rivets, screws, bolts, adhesives, welding, or other similar attachment means. The socket block 730 may alternatively be integrally formed with the pole 30 as a unitary piece.

The pole 30 serves as the height adjustment for the support 60 relative to the bracket 20 and thus the furniture the device is attached to during use. The pole 30 may be of any cross-section that allows it to engage the bracket 20 and be attached to the cylindrical post 422. In the preferred embodiment of the invention, the pole 30 has a square cross-section as illustrated, for example in FIGS. 1(*a*)–(*b*) and 6(*b*)–(*c*). The pole 30 preferably has a corresponding cross-section shaped to fit into the bracket 20.

The bracket 20 preferably includes a backbone channel (or column) 21, a tightener 22, two clamp pieces 24, 26, and a clamp adjuster 28 as illustrated in FIGS. 1(*a*)–(*b*) and 7(*a*)–(*c*). The backbone channel 21 preferably fits around the pole 30 and works in conjunction with the tightener 22 such that the tightener 22 engages the pole 30 and preferably holds it in place with frictional pressure. The tightener 22 may be a faucet handle instead of the knob handle shown, for example, in FIGS. 7(*a*)–(*c*). The backbone channel 21 preferably includes two gross adjustment slots 212 with notches 214 vertically spaced and extending from the slots 212 to interact with the clamp adjuster 28 as shown, for example, in FIG. 7(*a*). The slots 212 and notches 214 preferably run along opposing sides of the backbone channel 21 and preferably are identical to each other such that the clamp piece 26 and the clamp adjustor 28 together may freely move throughout both slots 212, 212.

The clamp adjuster 28 preferably is attached to one of the clamp pieces 26 with two pins 282. Each clamp piece preferably includes a pin 266 that engages the slots 212 and the notches 214 such that the clamp piece 26 may be moved along the height of the backbone channel 21 to adjust and better clamp about another object such as that illustrated in FIGS. 1(*a*)–2. More preferably, the pins 266 do not interfere with the ability of pole 30 to be adjusted within backbone channel 21. Alternatively, one of pins 282 and one of pins 266 may be integrally formed together. The clamp adjuster 28 preferably includes a frame 284 with a U or C-shape fit partially around the backbone channel 21, a tightening mechanism 286, and a base 288 as shown, for example, in FIGS. 7(*b*)–(*c*).

The tightening mechanism 286 may be anything known to one of ordinary skill in the art to apply pressure through the frame 284 against the base 288 to hold the adjuster 28 in a fixed position relative to the backbone channel 21. Preferably, the tightening mechanism 286 is a round knob, but may be instead a faucet handle as shown in FIGS. 8(*a*)–(*b*), with a threaded bolt that either abuts or engages the base 288, which in turn pushes the frame 284 away from the backbone channel 21 while pulling the attached clamping piece 26 and the two pins 282 into a respective notch 214. Preferably, the base 288 is rectangular as shown in FIGS. 7(*b*)–(*c*). The base 288 may include end ridges that further engage backbone channel 21 as illustrated in FIGS. 7(*b*)–(*c*). Alternatively, the base 288 may be circular as shown in FIG. 8(*b*).

An alternative embodiment of the base 288 includes a pair of aligners 289 extending between the base 288 into the frame 284. An example of the aligners 289 is shown in FIG. 7(*b*). The aligners 289 may be any type of structure that maintains the longitudinal length of the base 288 perpendicular to the backbone channel 21 and aligned with the frame 284.

The clamp piece 26 connected to the clamp adjuster 28 preferably is a member with a clamping surface 262 facing the other clamp piece 24 and two fingers 264 extending to partially frame the backbone channel 21. Each finger 264 preferably includes a hole to communicate with a respective pin 282. As the tightening mechanism 286 is tightened against the backbone channel 21, the clamp piece 26, if allowed, preferably will freely and slotingly pivot relative to the tightening mechanism 286 about the pins 266. An alternative embodiment replaces the hole with a vertical slot on each finger 264. The first clamping piece 26 together with the clamp adjuster 28 allows for a fine adjustment.

The second clamping piece 24 preferably is attached to the top of the backbone channel 21 or spaced from the top of the backbone channel 21. More preferably, the top of the second clamping piece 24 is flush with the top of the backbone channel 21. Preferably, the second clamping piece 24 is permanently attached to the backbone channel 21. The attachment may be accomplished in a variety of ways including for example, but not limited to, welding, bolts, rivets, screws, and adhesives. Preferably, the second clamping piece 24 completely encircles the perimeter of the backbone channel 21 as illustrated, for example, in FIGS. 2, 7(*a*), and 8(*a*). The second clamping piece 24 may instead only partially extend around the perimeter of the backbone channel 21. Another alternative is for the second clamping piece 24 to be integrally formed with the backbone channel 21 as a unitary piece.

Both clamping pieces 24, 26 preferably include terraced levels providing a variety of widths of potential items to attach the clamp 20 to during use. The terraced levels are illustrated, for example, in FIGS. 7(*a*) and 8(*a*).

Preferably, a screw or similar tightening instrument 22 passes through the backbone channel 21 to hold the pole 30 in place respective to the backbone channel 21. The screw 22 preferably is near the top of the backbone channel 21, and may also pass through the second clamping piece 24. The screw 22 may be tipped with material capable of gripping the pole 30 without damaging it such as rubber or a similar material.

An alternative embodiment for holding the support 60 is a pair of bar supports 56 preferably is a U-shape or partial square cross-section with an open top as illustrated, for example, in FIGS. 9(*a*)–(*b*). Each of the bar supports 56 preferably is similar to open ended troughs, more preferably one or both side walls will have cutouts 562 of the bar support 56 to reduce the amount of material needed for manufacture. Holding elements 564 preferably pass through the wall 544 and an outside wall to engage or abut the bar 62 when placed in the sling support thus securing the bar 62 in place.

In this alternative embodiment, the holding elements 564 number at least two and preferably number four total to hold the U-shape bar 62 in the pair of bar support 56 as shown, for example, in FIGS. 9(*a*)–(*b*). The holding elements 564 each preferably pass through respective holes in the bar support 56. Preferably, the holding elements 564 in conjunction with their respective holes are able to be secured and thus hold the bar 60 in place relative to the cradle 50. The holding elements 564 may be, for example, screws, bolts, bracketing mechanism, or similar items to be able to push and/or bracket the bar 60 against the other side of the sling supports opposite the wall the holding elements pass through.

A further modification to the bar supports 56 (or bar retainer 53) allows them to be placed at a variety of longitudinal positions with respect to the support element 54. To accomplish this, the bar supports 56 (or bar retainer 53) each have a slot or groove along one upright surface to be engaged by the holding elements 564 (or pressure mechanism 534). The holding element 564 (or pressure mechanism 534) are able to then pass through this slot or groove to hold the bar 62 in place.

Another alternative embodiment replaces the member 64 with netting as illustrated in FIGS. 1(*b*) and 2. Preferably, the replacement material includes some sort of meshing to allow for air to reach the extremity placed in the sling.

An alternative knee joint preferably includes two columns 41 and a polar rotational mechanism 42 as illustrated, for example, in FIGS. 10(*a*)–(*e*). The columns 41 may be attached to the bottom member 542 of the cradle 50 (the surface opposite of where the walls 544 project away from it) in a variety of ways including, for example, rivets, screws, bolts, adhesives, welding, or other similar attachment means. The columns 41 preferably are placed on either side of a central axis that cuts across the narrow width of cradle 50. In the embodiment illustrated, for example, in FIGS. 10(*a*)–(*e*), the two columns 41 are square and extend sufficiently below the cradle 50 to allow the cradle 50 to rotate through a variety of angles relative to the polar rotational mechanism 42. The columns 41 may be any shape that allows the polar rotational mechanism 42 to operate through its range of motion.

The polar rotational mechanism 42, for example, may include a cylindrical post 422, two locking mechanisms 424*a*, 424*b*, a connection coupler 426, a toothed cylinder 428, and a housing 429 as illustrated in FIG. 10(*e*). Preferably, the post 422 attaches to the pole 30 and extends into the housing 429 although post 422 and pole 30 may be integrally formed as one piece. The post 422 may be held more securely in place relative to the housing 429 by topping it with a bolt, a washer and a cap, or other similar restraining piece and placing a washer or similar item below the housing 429. The locking mechanism 424*a* preferably engages the coupling 426 within the housing 429. The locking mechanism 424*a* preferably includes a spindle 4242 that locks in place the coupler 426 and also causes the coupler 426 to engage some of the ridges that run longitudinally the surface of the toothed cylinder 428. The coupler 426 and the toothed cylinder 428 preferably are predominantly within the housing 429. The toothed cylinder 428 preferably connects the polar rotational mechanism 42 to the columns 41. Preferably, the toothed cylinder 428 is perpendicular to the coupler 426. The coupler 426 may be made up of multiple couplers, for example, a first coupler engaging the toothed cylinder 428 and a second coupler engaging the post 422 where the two couplers work together and are connected to be a third coupler.

To increase the strength of the locked position, a second locking mechanism 424*b* may be added to the opposite end of the housing 429 from the first locking mechanism 424*a* as illustrated in FIG. 10(*e*). The second locking mechanism 424*b* preferably will provide an additional locking force on the cylinder 428.

The polar rotational mechanism 42 preferably allows at least three types of rotation. The first rotation preferably is around the post 422. The second rotation preferably is around the coupler 426. The third rotation preferably is around the toothed cylinder 428.

Another alternative embodiment of the polar rotational mechanism is to have the locking mechanism engages a plug with a crescent shaped face abutting the pole and through coupling is able to move a corresponding plug on the other side of the pole. This structure may also be used about the toothed cylinder.

The preferred construction material for the device components for the invention is metal, more preferably aluminum or stainless steel, and most preferably stainless steel to decrease the likelihood of rusting and/or pitting of components and increase the ease of cleaning, in particular, blood and other bodily fluids. A resulting benefit is that the overall device will be more durable and sturdy. The end result is that it will be less likely that the various screw heads included as part of the bracket will break (or shear) off if bumped and/or collided into by another object or dropped. The slots and notches provide a gross adjustment while the first clamping piece and clamp adjuster provide a fine adjustment.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

I claim:

1. The device for raising a patient's arms above the patient's body comprising:

an extremity support, said extremity support includes a bar having two ends formed such that the two ends are pointing in the same direction and a side for each end, a member connecting the two sides, and wherein said extremity support having a pair of slots on opposing sides of said member that are each framed on three sides by said member and on one side by said bar, a cradle engaging said bar of said extremity support, said cradle is in communication with the slots of said extremity support, a knee joint connected to said cradle, a pole extending from said knee joint, and a bracket engaging said pole; and wherein said knee joint allows rotation of said cradle and said extremity support about said pole and said bracket, said member of said extremity support provides support for the patient's arm, and said extremity support is slidable and adjustable lengthwise with respect to said cradle.

2. The device according to claim 1, wherein said bar is U-shaped.

3. The device according to claim 1, further comprising a pad covering said member of said extremity support.

4. The device according to claim 1, wherein said member is concaved.

5. The device according to claim 1, wherein said cradle includes a base with two walls extending upwardly, a first bar retainer connected to one of said walls, and a second bar retainer connected to the other of said walls.

6. The device according to claim 5, wherein said first bar retainer includes a guide sleeve.

7. The device for raising a patient's arms above the patient's body comprising:

an extremity support, a cradle engaging said extremity support, said cradle includes a base with two walls extending upwardly, a first bar retainer connected to one of said walls, and a second bar retainer connected to the other of said walls, said second bar retainer includes a ledge connected to said other wall, a latch in communication with said extremity support, and at least one pressure mechanism engaging said latch a knee joint connected to said cradle, a pole extending from said knee joint, and a bracket engaging said pole; and wherein said knee joint allows rotation of said cradle and said extremity support about said pole and said bracket.

8. The device for raising a patient's arms above the patient's body comprising:

an extremity support, a cradle engaging said extremity support, a knee joint connected to said cradle, said knee joint includes at least one connector attached to said cradle, and a rotational mechanism in communication with said at least one connector, said rotational mechanism includes a toothed cylinder connected to said at least one connector, a coupler in communication with said toothed cylinder, a post in communication with said coupler, said post connected to said pole, and a locking mechanism engaging said coupler, a pole extending from said knee joint, and a bracket engaging said pole; and wherein said knee joint allows rotation of said cradle and said extremity support about said pole and said bracket.

9. The device according to claim 8, wherein said coupler includes a first coupler for engaging said toothed cylinder, a second coupler for engaging said post; and said first coupler and said second coupler provide relative rotation with respect to each other.

10. The device for raising a patient's arms above the patient's body comprising:

an extremity support, a cradle engaging said extremity support, a knee joint connected to said cradle, a pole extending from said knee joint, and a bracket engaging said pole, said bracket includes a column having a channel passing through its center and two sides each with a slot running at least a portion of its respective length, a tightener in communication with said column and engaging said pole, a first clamp piece connected to said column, a second clamp piece slidable along said column, a adjustor connected to said second clamp piece and in communication with said column; and wherein at least a portion of said pole is within the channel of said column, and said knee joint allows rotation of said cradle and said extremity support about said pole and said bracket.

11. The device according to claim 10, wherein said adjustor includes a frame, a tightening mechanism in communication with said frame, a base moved by said tightening mechanism, and two pins attached to said frame and in communication with said second clamp, and each of said pins is in communication with a respective slot of said column.

12. The device according to claim 10, wherein said first clamp piece and said second clamp piece have corresponding clamping surfaces.

13. The device according to claim 10, wherein said first clamp piece and said second clamp pieces each have a clamping surface that includes at least one curved portion and at least one flat portion.

14. A device for raising a patient's arms above the patient's body comprising:

an extremity support including a U-shaped bar, and a member connecting the two legs of said bar;

a cradle engaging said extremity support, said cradle includes a base with two walls extending upwardly, a first bar retainer connected to one of said walls, and a second bar retainer connected to the other of said walls;

a knee joint connected to said cradle, said knee joint includes two columns attached to said base, and a rotational mechanism in communication with said at least one connector;

a pole extending from said knee joint, and a bracket engaging said pole, said bracket includes a column having a channel passing through its center and two sides each with a slot running at least a portion of its respective length, a tightener in communication with said column and engaging said pole, a first clamp piece connected to said column, a second clamp piece slidable along said column, a adjustor connected to said second clamp piece and in communication with said column; and wherein at least a portion of said pole is within the channel of said column.

15. The device according to claim 14, wherein said adjustor includes a frame, a tightening mechanism in communication with said frame, a base moved by said tightening mechanism, and two pins attached to said frame and in communication with said second clamp, and each of said pins is in communication with a respective slot of said column.

16. The device according to claim 14, wherein said rotational mechanism includes a toothed cylinder connected to said at least one connector, a coupler in communication with said toothed cylinder, a post in communication with said coupler, and a locking mechanism engaging said coupler.

17. The device according to claim 14, wherein said rotational mechanism allows said extremity support to be angled to a x axis, a y axis, and a z axis.

* * * * *